US006938396B2

(12) United States Patent
Okamoto

(10) Patent No.: US 6,938,396 B2
(45) Date of Patent: Sep. 6, 2005

(54) CONTAINERS FOR PACKAGING GLASS SUBSTRATES

(75) Inventor: Fumio Okamoto, Kanagawa-ken (JP)

(73) Assignee: Corning Incorporated, Corning, NY (US)

( * ) Notice: Subject to any disclaimer, the term of this patent is extended or adjusted under 35 U.S.C. 154(b) by 99 days.

(21) Appl. No.: 10/326,654

(22) Filed: Dec. 20, 2002

(65) Prior Publication Data

US 2003/0085145 A1 May 8, 2003

Related U.S. Application Data

(62) Division of application No. 09/835,281, filed on Apr. 13, 2001, now Pat. No. 6,527,120.

(30) Foreign Application Priority Data

Oct. 20, 2000 (JP) ..... 2000-320327

(51) Int. Cl.[7] ..... B65B 35/50

(52) U.S. Cl. ..... 53/447; 53/540; 53/542; 53/428; 53/113; 53/111 R

(58) Field of Search ..... 53/542, 540, 428, 53/447, 113, 111 R; 206/449, 448

(56) References Cited

U.S. PATENT DOCUMENTS

| | | | | |
|---|---|---|---|---|
| 2,743,010 A | | 4/1956 | Koester | |
| 3,198,341 A | | 8/1965 | Sasaki | |
| 3,493,128 A | * | 2/1970 | Silvert | 206/451 |
| 3,688,679 A | | 9/1972 | Carlson | |
| 3,838,779 A | * | 10/1974 | Dawson | 414/778 |
| 3,995,738 A | | 12/1976 | Rowley et al. | |
| 4,287,990 A | | 9/1981 | Kurick | |
| 4,320,836 A | * | 3/1982 | Brown et al. | 206/451 |
| 4,424,902 A | | 1/1984 | Silinsky et al. | |
| 4,609,112 A | | 9/1986 | Belanger et al. | |
| 4,805,774 A | | 2/1989 | Salisbury | |
| 4,815,601 A | | 3/1989 | Peterson et al. | |
| 5,085,030 A | * | 2/1992 | Segawa et al. | 53/399 |
| 5,148,924 A | | 9/1992 | Mason et al. | |
| 5,269,422 A | | 12/1993 | Chevrette | |
| 5,484,064 A | | 1/1996 | Melichar | |
| 5,518,348 A | * | 5/1996 | Tucker | 410/99 |
| 5,522,205 A | * | 6/1996 | Weder | 53/475 |
| 5,577,621 A | | 11/1996 | Yi | |
| 5,588,531 A | | 12/1996 | Yoshida et al. | |
| 5,644,898 A | * | 7/1997 | Shepherd et al. | 53/445 |
| 5,678,691 A | * | 10/1997 | Amado-Aguilar et al. | 206/451 |
| 5,904,251 A | | 5/1999 | Ogata et al. | |
| 6,478,354 B1 | * | 11/2002 | Eyal | 294/74 |

FOREIGN PATENT DOCUMENTS

| | | |
|---|---|---|
| DE | 195 20 645 | 12/1996 |
| DE | 199 58 516 | 1/2001 |
| FR | 2 340 876 | 9/1977 |
| JP | 2000-327075 | 11/2000 |

OTHER PUBLICATIONS

Computer generated English translation of DE 199 58 516 obtained from the World Lingo website, worldlingo.com.
Computer generated English translation of DE 199 58 516 obtained from the FreeTranslation website, freetranslation.com.

* cited by examiner

*Primary Examiner*—Stephen F. Gerrity
*Assistant Examiner*—Hemant Desai
(74) *Attorney, Agent, or Firm*—Maurice M. Klee

(57) ABSTRACT

Containers (19) are provided for packaging flexible substrates (13) such as the glass substrates used in the manufacture of liquid crystal displays. The containers include arc-shaped grooves (25) which apply an elastic strain to the substrates. The elastic strain stiffens the substrates and thus reduces the likelihood of damage to the substrates as a result of vibration during transport or sagging when held horizontally. Through the use of such grooves, dense packaging of large, thin substrates is achieved.

8 Claims, 3 Drawing Sheets

FIG. 1A.
PRIOR ART
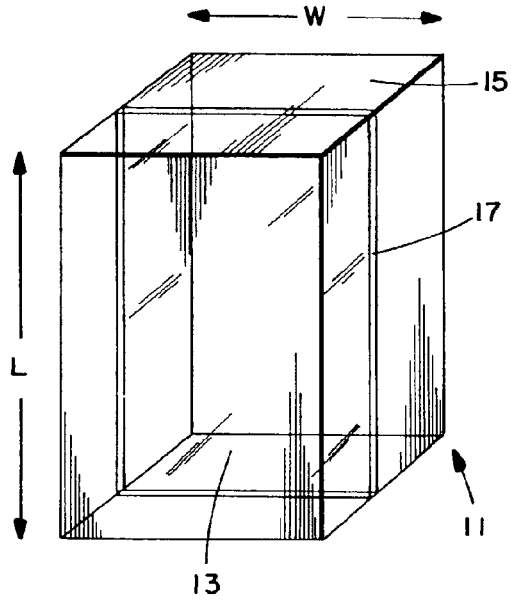
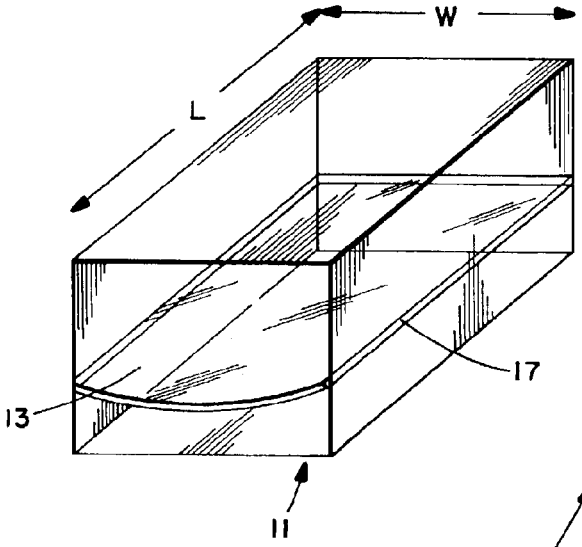
FIG. 1B.
PRIOR ART
FIG. 2.
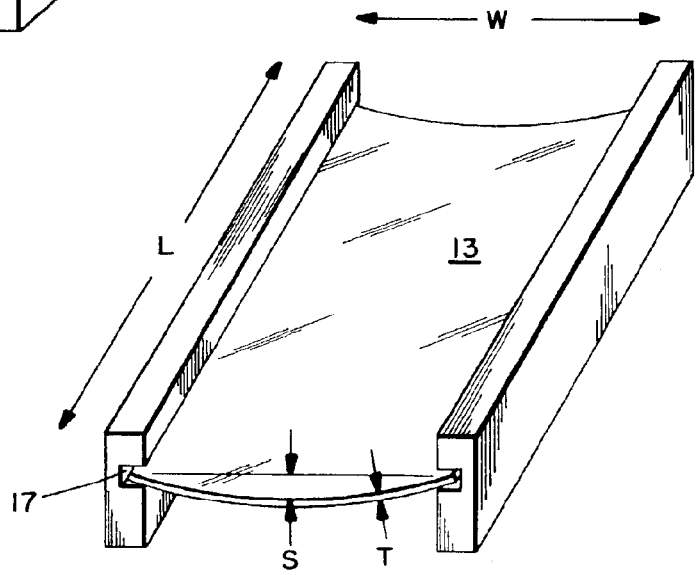

CONTAINERS FOR PACKAGING GLASS SUBSTRATES

CROSS REFERENCE TO RELATED APPLICATION

This is a divisional application of U.S. application Ser. No. 09/835,281 filed on Apr. 13, 2001, now U.S. Pat. No. 6,527,120 the contents of which in its entirety is hereby incorporated by reference.

I. FIELD OF THE INVENTION

This invention relates to packaging of glass substrates (glass sheets) and, in particular, to the dense packing of glass substrates of the type which are subject to high levels of flexing as a result of vibration during transport and a significant gravity sag when held horizontally.

More generally, the invention relates to high density packaging of sheets of any material for which flexing during transport and/or gravity sag when held horizontally is a problem, e.g., sheets having surfaces that can be damaged through contact and/or sheets that are brittle and can break through contact and/or excessive flexing. For ease of presentation, however, the following discussion is in terms of sheets of glass, specifically, sheets of glass for use in manufacturing liquid crystal displays (LCDs), it being understood that the invention as defined in the appended claims is not so limited except for those claims which specify that the material is glass or a liquid crystal display glass.

II. BACKGROUND OF THE INVENTION

Large, thin glass sheets are used as substrates for liquid crystal displays. During transport from a glass manufacturing facility to a customer, the substrates are packaged either in an L-shape support or in a polypropylene box, each sheet being separated from its neighbors by having its non-quality edges held in grooves. See U.S. Pat. Nos. 5,588,531 and 5,904,251.

The flexibility of such substrates increases as the size of the sheet increases and/or its thickness decreases. Such an increase in flexibility, in turn, means that the sheets exhibit a higher level of flexing as a result of vibration during transport and a larger gravity sag when held horizontally. As a result, a large spacing between sheets and careful transport are required to avoid glass damage and breakage due to excess flexing (bending) and/or contact between adjacent sheets. Such a large spacing increases the costs of storing, transporting, and handling the substrates.

A need has thus existed for improved techniques for packaging flexible substrates that allow the substrates to be packed closer to each other and to exhibit less horizontal sag than with existing techniques. This need has intensified in recent years and is expected to be even more pressing in the future as glass substrates for LCD applications become larger and thinner, and thus more flexible. The present invention addresses this continuing need in the art.

III. SUMMARY OF THE INVENTION

In view of the foregoing, it is an object of this invention to provide apparatus and methods for overcoming the flexing and sag problems exhibited by large and/or thin substrates. It is an additional object of the invention to provide methods and apparatus for increasing the packaging density of flexible substrates. It is a specific object of the invention to reduce the likelihood of damage to a flexible substrate as a result of vibration during transport and/or sag when held horizontally.

To achieve these and other objects, the invention in accordance with one of its aspects provides a container (19) for holding a plurality of sheets (13) of a flexible material, said sheets being flat in their non-stressed condition, said container comprising a first side (21) and an opposing second side (23), the first side comprising a first plurality of curved grooves (25) and the second side comprising a second plurality of curved grooves (25), wherein the first and second pluralities of curved grooves are aligned with each other so as to form a plurality of pairs of curved grooves, each pair being adapted to receive a sheet of the flexible material, each curved groove of each pair having substantially the same radius of curvature (R), said radius of curvature being selected to apply an elastic strain to the sheet of flexible material to thereby reduce the likelihood of contact between sheets in adjacent pairs of grooves as a result of handling of the container. Preferably, the radius of curvature is greater than two meters and less than five meters, although other radii of curvature can be used in the practice of the invention if desired.

In accordance with another of its aspects, the invention provides a method for increasing the number of sheets of a flexible material that can be transported in a container, said sheets being flat in their non-stressed condition, said method comprising applying an elastic strain to at least one of the sheets while the sheet is in the container to reduce the likelihood of contact between the sheet and an adjacent sheet as a result of handling of the container. Preferably, an elastic strain is applied to each of the sheets in the container and, most preferably, the same elastic strain is applied to all of the sheets.

Additional features and advantages of the invention are set forth in the detailed description which follows, and in part will be readily apparent to those skilled in the art from that description or recognized by practicing the invention as described herein.

It is to be understood that both the foregoing general description and the following detailed description are merely exemplary of the invention, and are intended to provide an overview or framework for understanding the nature and character of the invention as it is claimed.

The accompanying drawings are included to provide a further understanding of the invention, and are incorporated in and constitute a part of this specification. The drawings illustrate various embodiments of the invention, and together with the description serve to explain the principles and operation of the invention.

IV. BRIEF DESCRIPTION OF THE DRAWINGS

FIG. 1A shows a prior art container, e.g., a polypropylene container, for transporting glass LCD substrates. As shown in this figure, the container is in a vertical position with its lid in place. For this construction, the center of the glass sheet flexes during transport.

FIG. 1B shows the container of FIG. 1A in a horizontal position with its lid removed. As illustrated in this figure, the glass sheet exhibits gravity sag along its front edge.

FIG. 2 shows a glass sheet supported horizontally by straight grooves along two side edges.

Figure 4:
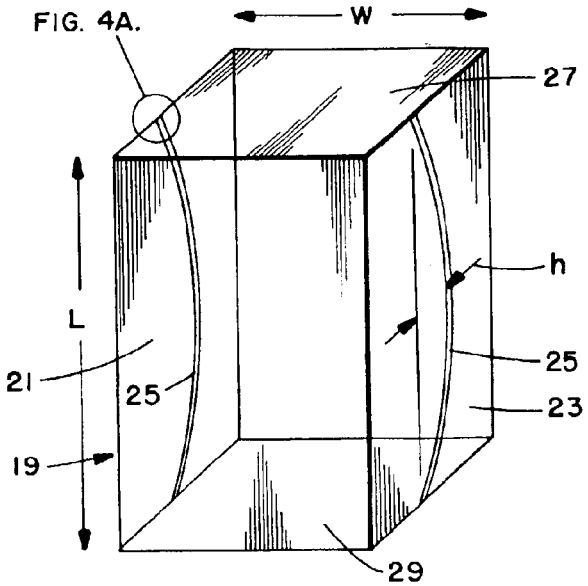

FIG. 4 shows the structure of the packaging box used to obtain the experimental results reported in the examples set forth below. Five pairs of grooves were fabricated in opposing walls of the box with a spacing between grooves of 5 mm. Only one pair of grooves is shown FIG. 4.

Figure 4A:
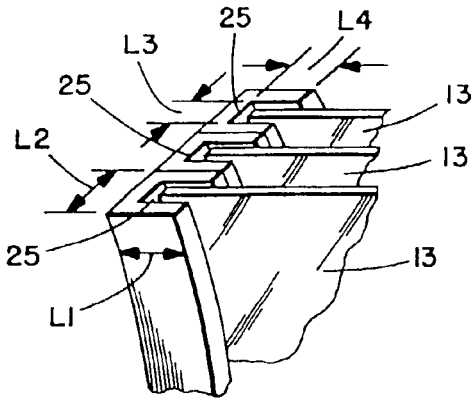

FIG. 4A is an exploded schematic drawing of the region circled in FIG. 4 showing three of the five grooves of the packaging box used in the examples.

Figure 3A:
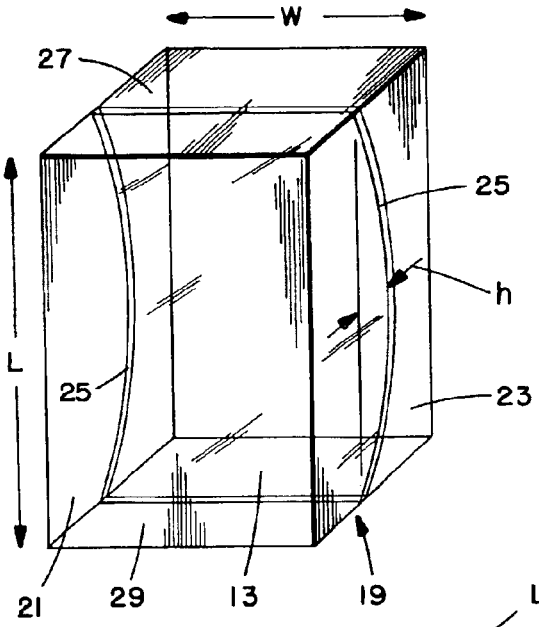
FIG. 3A shows a container, e.g., a polypropylene container, constructed in accordance with the invention in a vertical position. The glass sheet shown in this figure is elastically strained by the arc-shaped grooves of the container and thus does not exhibit substantial flexing when subjected to vibration.
Figure 3B:
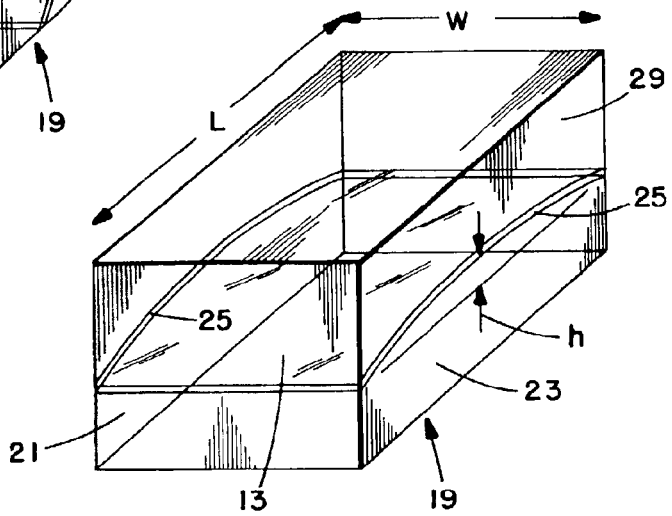
FIG. 3B shows the container of FIG. 3A in a horizontal position with its lid removed. Since the glass sheet is elastically strained by the arc-shaped grooves of the container, it exhibits essentially no gravity sag.
Figure 5:
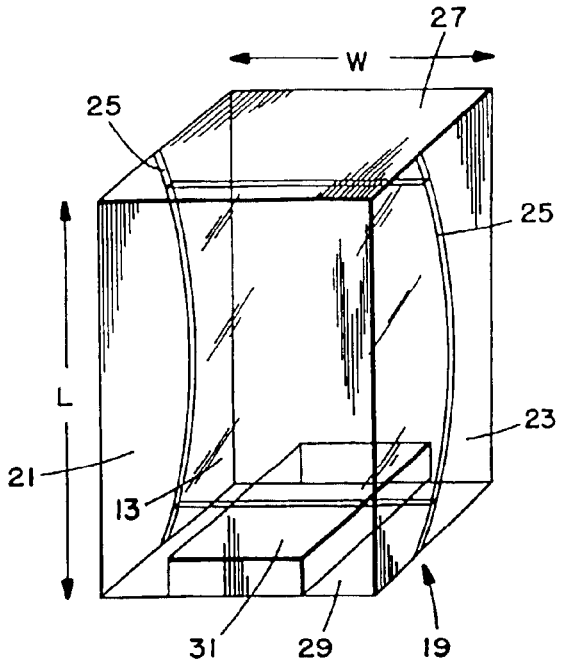

FIG. 5 shows a modified version of the container of FIG. 3 which includes an elevated bottom section that allows the container to be used with sheets of glass whose length is less than the full length of the arc-shaped grooves.

Figure 6:
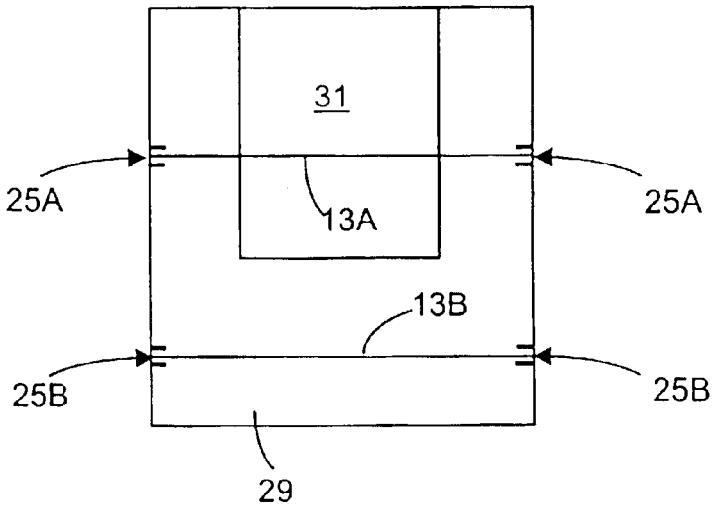

FIG. 6 is a schematic plan view of a variation of FIG. 5 in which the elevated bottom section (substrate support 31) reduces the extent to which a sheet can be inserted into one pair of grooves (25A) more than in one other pair of grooves (25B).

The reference numbers used in the drawings correspond to the following:

| | |
|---|---|
| 11 | prior art container for transporting substrates |
| 13 | substrate |
| 15 | lid of prior art container 11 |
| 17 | straight groove of prior art container 11 |
| 19 | container of the present invention |
| 21 | first side of container 19 |
| 23 | second side of container 19 |
| 25 | arc-shaped groove of container 19 |
| 27 | lid or top of container 19 |
| 29 | bottom of container 19 |
| 31 | substrate support |

To facilitate the presentation of the invention, it has been assumed in the drawings that the walls of container 19 of the invention as well as those of prior art container 11 are transparent so that a glass sheet within the box can be seen from the outside. In practice, although these walls could be transparent, they will normally be opaque.

Again for ease of presentation, only one glass sheet and one set of grooves for holding the sheet is shown in FIGS. 1, 3, 4, and 5, it being understood that in practice, the containers of these figures have multiple pairs of grooves and carry multiple sheets of glass, one sheet per pair of grooves.

V. DETAILED DESCRIPTION OF THE INVENTION

As discussed above, the present invention relates to the problem of improving the packaging of sheets of glass and other materials so as to reduce the amount of flexing and gravity sag which the sheets exhibit. Such a reduction in flexing and sag permits the packing density of the sheets within a shipping container to be increased, i.e., for the same overall size of a container, more sheets can be shipped.

Currently, thin glass substrates (e.g., substrates having a thickness less than or equal to 1.1 millimeters and, in many cases, less than or equal to 0.7 millimeters) are packaged vertically in, for example, a polypropylene box 11 having straight grooves 17 as shown in FIG. 1A. Typically, ten to twenty-five substrates 13 are packaged in a box with a spacing between substrates ranging from 10 to 18 mm depending on the glass size and thickness. The lid and bottom of the box also have straight grooves 17 so that the four edges of each substrate are supported by grooves. Even so, the center of large, thin glass substrates flexes easily with vibration during transport.

At the unloading of the substrates, the lid of the box is removed and the box is rotated to a horizontal position as shown in FIG. 1B. In this position, only three edges of the glass substrate are supported by grooves, and thus the front edge of the substrate sags by gravity. The amount of this sag can be estimated using the following equation which assumes that the glass sheet is supported horizontally by straight grooves along two of its side edges (see FIG. 2):

$$S=(5\rho/32E)(W^4/T^2) \quad (1)$$

where E is Young's modulus, ρ is density, W is width, and T is thickness. As can be seen from this equation, the gravity sag sharply increases with increasing width W and decreasing thickness T.

For a typical liquid crystal display glass, specifically, Code 1737 glass produced by Corning Incorporated (Corning, N.Y.), E equals 7500 kg/mm$^2$ and ρ equals $2.54\times10^{-6}$ kg/mm$^3$. Table 1 gives calculated gravity sag values (S values) for a 0.7 mm-thick sheet of Code 1737 glass for glass widths (W values) ranging from 100 mm to 1,000 mm. At W=600 mm, for example, the calculated gravity sag amounts to 14 mm, while at W=1,000 mm, it grows to 108 mm.

The current technique for packaging substrates deals with this sheet flexibility by making the spacing between adjacent sheets sufficiently large to avoid touching of the sheets with one another as a result of vibration or gravity. As can be seen from Equation (1) and Table 1, the problems caused by flexing increase rapidly when either glass size becomes larger or glass thickness becomes smaller. For such larger and/or thinner sheets, the current packaging technique rapidly becomes costly, inefficient, and ineffective.

The present invention overcomes this problem by reducing the flexibility of the glass sheets so that they do not touch each other as a result of vibration or gravity even when packed close together. The reduction in flexibility is achieved by elastically straining the substrates so as to increase their stiffness and reduce their flexibility. As a result, the substrates vibrate less during transport and sag less when held in a horizontal position.

Preferably, the substrates are subjected to sufficient elastic strain so that they essentially do not vibrate when subjected to the forces normally encountered during the shipment and handling of a container for a glass substrate. Similarly, the elastic strain is also sufficient to ensure that the substrates undergo essentially no gravity sag when held in a horizontal position.

The elastic strain is applied to the substrate through a pair of grooves formed in opposing walls of the container. Groove configurations of various types can be used to produce the desired strain in the substrate. For example, a pair of sinusoidal grooves will apply an elastic strain to a substrate. However, for such grooves, the curvature changes along the groove length, and accordingly the strains in the glass sheet vary as the glass sheet slides into the groove. As a result, the glass sheet will not in general move smoothly along a pair of grooves.

The preferred groove shape is an arc, i.e., a portion of a circle, as shown in FIG. 3. With this configuration, the substrate is strained uniformly along the groove length because the curvature is constant along the arc, that is, the strains in the glass are independent of the position along the groove. Accordingly, glass sheets having different lengths can be packaged in the same packaging box at the same strain condition, provided that the widths of the sheets are the same. As a result of the strain, one surface of the glass sheet is under compression, i.e., the surface facing the center of curvature, and the other surface is under tension, i.e., the surface away from the center of curvature.

Wider and thinner glass sheets require a larger bending height (h) or, equivalently, a smaller arc radius, to achieve a desired level of stiffness. The amount of bending used should be the minimum that achieves the level of stiffness required to avoid damage from vibration and/or sagging. Higher levels are considered undesirable since they can potentially result in static fatigue of the glass sheet, especially when the sheet is kept in a packaging box for a long period. In this regard, it was observed that a glass sheet kept in a groove which had an "h" value of 30 mm (see FIG. 3) for 18 days showed no apparent static fatigue.

The grooves are placed in opposing sides 21 and 23 of container 19. If desired, straight grooves can also be placed in lid 27 and/or bottom 29 of the container, although generally such additional grooves will not be used.

If desired, container 19 can include a substrate support 31 as shown in FIG. 5 which allows the container to be used with substrates whose length is less than the full length of a groove. Such a support allows such shorter substrates to be packaged without concern that the substrate may move within its pair of grooves during handling.

The substrate support can be at the bottom 29 of the container as shown in FIG. 5 or at its top or lid 27. Alternatively, substrate supports can be used at both the bottom and the top of the container. The substrate support(s) can be a separate component or an integral part of the container or its lid. The substrate support can support all of the substrates in a container or just some of the substrates. Compare FIG. 5 where substrate support 31 can support all substrates 13 packaged in container 11 with FIG. 6 where substrate support 31 can support a sheet 13A placed in grooves 25A, but not a sheet 13B placed in grooves 25B. Moreover, the support can have more than one level, e.g., the support can be stepped. In this way, a single container can be used to transport a variety of substrates having a common width and different lengths.

Without intending to limit it in any manner, the present invention will be more fully described by the following examples.

EXAMPLE 1

Arc-shaped grooves were fabricated inside the package box of FIG. 3 for W=600 mm and L=900 mm. With this design, glass sheets having a width of 600 mm and lengths up to approximately 900 mm can be packaged.

Grooves having different "h" values (see FIG. 3) were prepared to test the effect of bend radius on stiffness. In particular, grooves having the following six bending heights were prepared: h=10, 20, 30, 40, 50, and 60 mm. Table 2 gives the arc radii (R) corresponding to these bending heights (h).

Code 1737 glass substrates having a width of 600 mm, a length of 720 mm, and a thickness of 0.7 mm were put into the arc-shaped grooves. A substrate support 31 was used at the bottom of the box as shown in FIG. 5 since the length of the substrate was less than 900 mm. For all of the bending heights tested, the glass slid into the grooves without breakage.

As shown in Table 3, the glass substrates became stiff when bent, with the stiffness increasing as the bending height increased. As set forth in this table, even a bending height of just 10 to 20 mm substantially increased the stiffness. At a bending height of 30 mm, the glass became sufficiently rigid so that it exhibited no flexing by shaking nor gravity sag at the horizontal position.

Bending heights above 40 mm seemed to be excessive for the glass width of 600 mm. It is expected that a bending height more than 30 mm will be required for glass sheets wider than 600 mm because wider glass is more flexible.

EXAMPLE 2

Five pairs of arc-shape grooves having a bending height (h) of 30 mm were arrayed with a spacing of 5 mm. FIG. 4A and Table 4 show the dimensions of the grooves used in this experiment, it being understood that these are purely representative dimensions and are not intended to limit the invention in any way.

Five glass substrates of the type used in Example 1 were packed into these five pairs of grooves without any problems. Because the substrates were subject to elastic strain, they became rigid when held in the grooves and showed no flexing by shaking nor gravity sag at the horizontal position.

Significantly, the spacing currently being used to package substrates of this type ranges from 10 to 18 mm. The arc-shaped packaging of the present invention with a 5 mm spacing between grooves can thus double or triple the packaging capacity for a given box size.

Although specific embodiments of the invention have been described and illustrated, it will be apparent to those skilled in the art that modifications and variations can be made without departing from the invention's spirit and scope. The following claims are thus intended to cover the specific embodiments set forth herein as well as such modifications, variations, and equivalents.

TABLE 1

Calculated Gravity Sag (S) Versus Glass Width (W) for a Glass Sheet Having $E = 7500\ kg/mm^2$, $\rho = 2.54 \times 10^{-6}\ kg/mm^3$, and $T = 0.7$ mm

| W (mm) | S (mm) |
|---|---|
| 100 | 0.0 |
| 200 | 0.2 |
| 300 | 0.9 |
| 400 | 2.8 |
| 500 | 6.7 |
| 600 | 14.0 |
| 700 | 25.9 |
| 800 | 44.2 |
| 900 | 70.9 |
| 1000 | 108.0 |

TABLE 2

Arc Radii (R) Corresponding to Bending Heights (h) for L = 900 mm in FIG. 3

| h (mm) | R (m) |
|---|---|
| 10 | 10.1 |
| 20 | 5.1 |
| 30 | 3.4 |
| 40 | 2.5 |
| 50 | 2.0 |
| 60 | 1.7 |

TABLE 3

| Observed Stiffness Versus Bending Height (h) | |
|---|---|
| h (mm) | Observed Stiffness |
| 10 | Stiff with some flexibility |
| 20 | Stiff with little flexibility |
| 30 | Rigid (no flexing by shaking and no gravity-sag at the horizontal position) |
| 40 | Rigid (excessively strained) |
| 50 | Rigid (excessively strained) |
| 60 | Rigid (excessively strained) |

TABLE 4

| Representative Groove Dimensions of FIG. 4A for Use With Glass Sheets Having a Thickness of 0.7 Millimeters | |
|---|---|
| L1 | 5 mm |
| L2 | 5 mm |
| L3 | 2.5 mm |
| L4 | 4 mm |

What is claimed is:

1. A method for transporting sheets of glass in a container, said glass sheets being flat in their non-stressed condition, said method comprising applying an elastic strain to at least one of the glass sheets while the glass sheet is in the container, said elastic strain being applied by curving the sheet so that it has a bending height of at least 10 millimeters to thereby reduce the likelihood of contact between the glass sheet and an adjacent glass sheet as a result of handling of the container.

2. The method of claim 1 wherein an elastic strain is applied to each of the sheets in the container.

3. The method of claim 2 wherein the same elastic strain is applied to each of the sheets in the container.

4. The method of claim 1 wherein the radius of curvature of the curved glass sheet is greater than two meters and less than five meters.

5. The method of claim 1 wherein the sheet has two opposing edges and the elastic strain is applied by holding only those edges in a pair of curved grooves.

6. The method of claim 1 wherein the glass is a liquid crystal display glass.

7. The method of claim 1 wherein the glass has a thickness which is less than or equal to 1.1 millimeters.

8. The method of claim 1 wherein the glass has a thickness which is less than or equal to 0.7 millimeters.

* * * * *